US005291249A

United States Patent [19]

Lee

[11] Patent Number: 5,291,249

[45] Date of Patent: Mar. 1, 1994

[54] LIGHT EMITTING DIODE PRINTER

[75] Inventor: Dong-Ho Lee, Seongnam, Rep. of Korea

[73] Assignee: SamSung Electronics Co., Ltd., Suwon, Rep. of Korea

[21] Appl. No.: 5,360

[22] Filed: Jan. 19, 1993

Related U.S. Application Data

[63] Continuation-in-part of Ser. No. 870,914, Apr. 20, 1992, Pat. No. 5,262,827.

[51] Int. Cl.[5] ..... G03G 15/04

[52] U.S. Cl. ..... 355/229; 355/200; 355/210; 355/228; 355/67; 346/160.1

[58] Field of Search ..... 355/200, 210, 211, 228, 355/229, 67; 346/155, 158, 159, 160.1

[56] References Cited

U.S. PATENT DOCUMENTS

| | | | |
|---|---|---|---|
| 4,634,264 | 1/1987 | Takahashi | 355/210 |
| 4,876,572 | 10/1989 | Nagatsuna | 355/210 |
| 4,951,070 | 8/1990 | Theodoulou et al. | 346/155 |
| 5,005,053 | 4/1991 | Kozuka | 355/200 X |
| 5,089,846 | 2/1992 | Tabuchi | 355/200 |
| 5,095,335 | 3/1992 | Watanabe et al. | 355/210 |
| 5,095,337 | 3/1992 | Yamaguchi | 355/229 |
| 5,218,383 | 6/1993 | Kondou et al. | 355/229 X |

*Primary Examiner*—Matthew S. Smith
*Attorney, Agent, or Firm*—Robert E. Bushnell

[57] ABSTRACT

An LED printer constructed with a lower body frame, an upper body frame, a process unit having an upper leading end for mounting a photo-sensitive drum in a housing, an LED frame for supporting an LED head array beneath its right end portion, a pair of through holes formed adjacent to the right end of the LED frame, a pair of blind holes formed on the LED head array facing and aligned with the pair of through holes, and a pair of threaded bolts respectively received by the pair of through holes for connecting the LED head array to the LED frame by respectively fixing the lower ends of the pair of threaded bolts in the pair of blind holes. A pair of compression springs are interposed between the LED frame and head array and enclose corresponding ones of the pair of threaded bolts in order to exert a resilient force on the LED head array. A pair of LED positioning plates formed on both upper side ends of the housing. When an image process unit is installed inside the upper body frame, the upper leading end pushes the lever so as to pivot the LED frame together with the LED head array clockwise, so that both lower side end surfaces of the LED head array respectively contact the pair of LED positioning plates under the resilient force of the pair of compression springs and thus the gap between the photo-sensitive drum and LED head array is properly established and maintained.

28 Claims, 6 Drawing Sheets

LIGHT EMITTING DIODE PRINTER

CROSS-REFERENCE TO RELATED APPLICATIONS

This application makes reference to, incorporates the same herein, is a continuation-in-part of and claims all benefits incurring under 35 U.S.C. §§ 119 and 120 from a co-pending application for A LIGHT EMITTING DIODE PRINTER filed in the U.S. Patent & Trademark Office on Apr. 20, 1992 and assigned Ser. No. 07/870,914 (now U.S. Pat. No. 5,262,827), and an application filed in the Korea Industrial Property Office on Apr. 22, 1991 and assigned Ser. No. 1991/6427.

BACKGROUND OF THE INVENTION

1. Technical Field

The present invention relates to a light emitting diode (LED) printer, and more particularly, to a mechanism for changing the process unit thereof.

2. Background Art

Conventional designs of printers relying upon light emitting diode arrays have pivotally connected upper and lower frames enclosing a photosensitive drum and developer assembly, a fixer, and a paper conveying assembly. U.S. Pat. No. 3,985,436 for example, mentions a photo processing unit having a cleaning device, photo-sensitive drum, electric charger, and developer. An LED frame is manually opened and closed by pivoting upon a hinge. In order to change the process unit, the upper body frame is first opened, and then a lever on the frame is pressed so as to release a hook engaging the upper body frame. Thus, the LED frame is opened upwardly in order to remove the process unit from the unit guide.

If however, the process unit is mounted in the unit guide and the frame including the LED head array is pivoted downwardly on the hinge, the book is held by the upper body frame so that the LED head array may be positioned facing the photo-sensitive drum through an opening formed in the upper part of the unit guide at a fixed interval therebetween. Such designs fail to accommodate a range of manufacturing tolerances as well as changes of tolerances occurring during usage attributable to wear and tear of, -for example, slight manufacturing misalignment or gradual wear of the hook engaging the upper body frame. Consequently, contemporary designs do not assume maintenance of a constant gap between the light emitting diode array and the photosensitive drum.

Such contemporary designs of conventional LED printers are complicated, and require manual disassembly and reassembly of the related component parts in order to change the process unit.

SUMMARY OF THE INVENTION

It is therefore, one object of the present invention to provide a mechanism enabling quick and easy replacement of the process unit in an LED printer.

It is another object to provide a mechanism for maintaining a constant gap between an LED head array and a photo-sensitive drum in a LED printer.

It is still another object to provide a process and apparatus for continuously and accurately position an array of light emitting diodes relative to a photo-sensitive drum of a printer.

It is yet another object to provide a process and apparatus accommodating a wider range of manufacturing and operational tolerances while maintaining correct disposition of an array of light emitting diodes relative to a photo-sensitive surface.

These and other objects may be achieved with a light emitting diode (LED) printer constructed according to the principles of the present invention with a lower body frame and an upper body frame openably/closeably mounted on the lower body frame to accommodate a process unit with an upper leading end, and mounting a photosensitive drum in a housing. A LED frame with a lever mounted by means of a pivot on the upper body frame for supporting a LED head array beneath its right most end portion. A pair of through holes are formed adjacent to the right side of the LED frame, a pair of blind holes are formed on the LED head array aligned with and facing corresponding ones of the pair of through holes, a pair of threaded bolts are received by the pair of through holes for connecting the LED head array to the LED frame by threading fixing the lower ends of the pair of threaded bolts into the threads of a pair of blind holes each of a pair compression springs is interposed between the LED frame and head array and to surround corresponding ones of the pair of threaded bolts in order to exert resilient force on the LED head array. A resilient component is positioned between the LED frame and upper body frame for drawing upwardly the portion of the LED frame supporting the LED head array, while a pair of LED positioning plates are formed on both upper side ends of the housing of the printer. The LED frame pivots as a bellcrank around a trunnion as the upper leading end of a process unit pushes against the LED frame so as to pivot the LED frame together with the LED head array clockwise when the process unit is installed inside the upper body frame in order that both lower side end surfaces of the LED head array simultaneously contact the pair of LED positioning plates under the resilient forces of the pair of compression springs. Consequently, the gap between the photo-sensitive drum and LED head array is consistently maintained.

The present invention will now be described more specifically with reference to the drawings attached only by way of example.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF CERTAIN PREFERRED EMBODIMENTS

Figure 1:
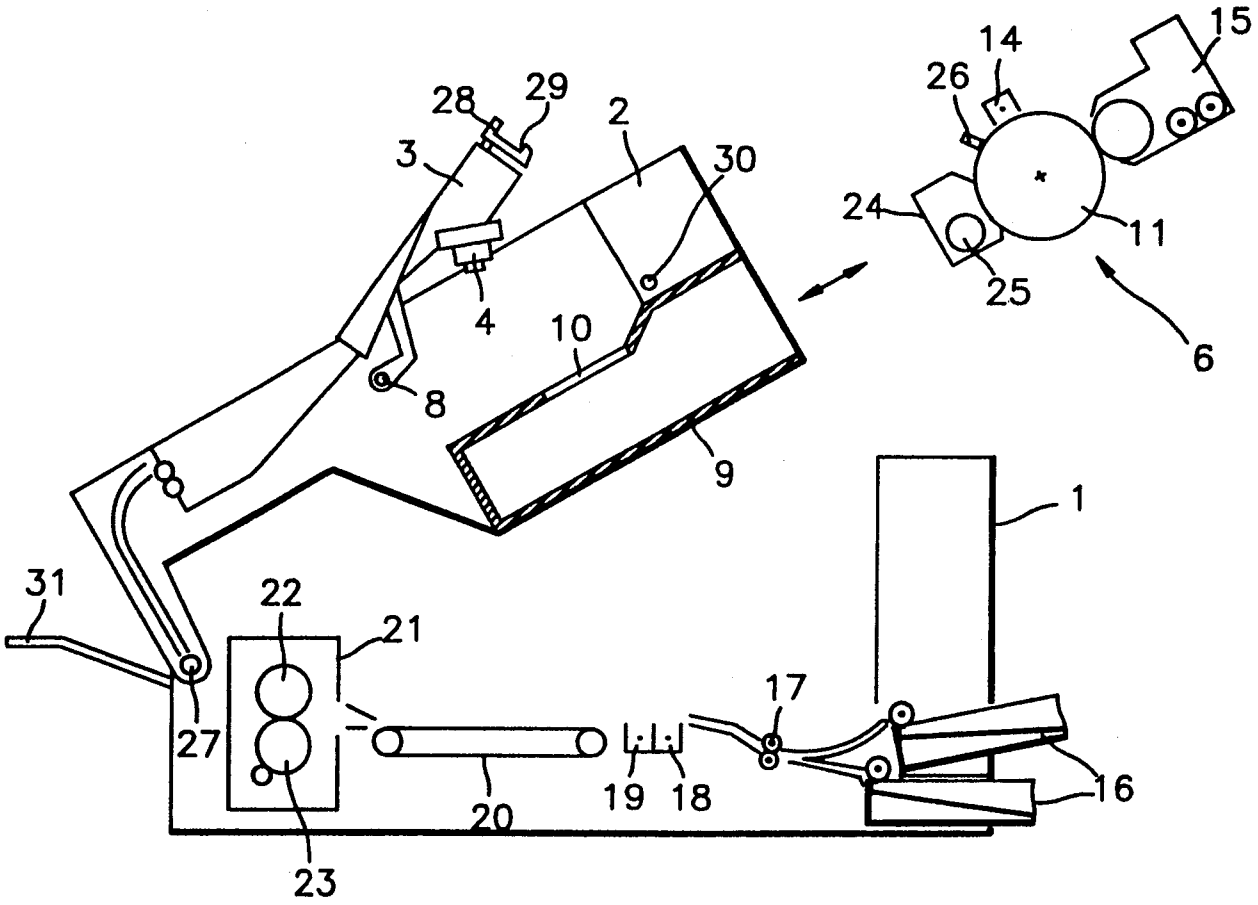
FIG. 1 is a cross-sectional view for illustrating the structure of a conventional LED printer.

Turning now to the drawings, FIG. 1 shows a conventional LED printer with a control circuit (not shown) regulating an LED head array 4 to expose a photo-sensitive drum 11 within an image process unit 6 to light, in response to an instruction for printing data received from a computer (not shown). The surface of the photo-sensitive drum 11 is charged with a constant voltage by an electric charger 14, and the portions of the photo-sensitive drum 11 exposed to light by the LED head array 4 come to have reduced voltages, so that an electrostatic latent image is formed on the photo-sensitive drum 11 due to the voltage differences between the initially charged voltage of the portions of drum 11 not exposed to the light and the reduced voltages of the portions of drum 11 exposed to the light. Thereafter, as the photo-sensitive drum 11 is rotated, the toner of a process unit such as developer 15 is attracted to the surface of the photo-sensitive drum 11 so as to develop the latent image.

Meanwhile, sheets of printing paper are supplied from one of a plurality of paper supplying trays 16, aligned by a pair of register rolls 17, and conveyed to a transferring device 18 where the toner developing the latent image on the photo-sensitive drum 11 is transferred to the printing paper. The printing paper adhering to the photo-sensitive drum through electrostatic force is separated from the photo-sensitive drum 11 by a separator 19, and conveyed by a conveyor belt 20 to a fixing device 21, where the printing paper is heated and pressed between a heat roll 22 and pressure roll 23 to fix the toner. The residual toner on the photo-sensitive drum 1 1 is removed by a cleaning device 24, transmitted through an auger 25 to a vessel for collecting the used toner and the latent image is canceled by the light supplied from a latent image removing lamp 26. The printed paper is then conveyed to a discharge tray 31.

If a sheet of printing paper is jammed inside of the printer however, the upper body frame 2 may be upwardly pivoted on a hinge 27 so as to be detached from the lower body frame 1 to enable removal of the jammed printing paper.

The paper supply trays 16, fixing device 21, transferring device 18, etc. are generally contained within the lower body frame 1. The upper body frame 2 has a receptacle 9 for receiving the process unit 6 with the cleaning device 24, photo-sensitive drum 11, electric charger 14, and developer 15, and on the upper side of upper body frame 2 is mounted an LED frame 3 for supporting the LED head array 4. A typical design of a process unit 6 having the cleaning device 24, photo-sensitive drum 11, electric charger 14, and developer 15 is disclosed in the earlier mentioned U.S. Pat. No. 3,985,436. LED frame 3 is manually opened and closed by pivoting upon a pivot 8. Hence, in order to change process unit 6, first the upper body frame 2 is opened, and then lever 28 on the frame 3 is pressed so as to release a hook 29 engaging holding pin 30 attached to the upper body frame 2. Thus, the LED frame 3 may be opened upwardly so as to enable removal of process unit 6 from the receptacle provided by unit guide 9.

If the process unit 6 is then mounted inside guide unit 9, and the frame 3 including the LED head array 4 is pivoted downwardly upon pivot 8, hook 29 of lever 28 is held stationary by the pin 30, so that LED head array 4 will be positioned facing the photo-sensitive drum 11 through opening 10 formed in the upper part of the unit guide 9 with a some interval therebetween.

The design of the conventional LED printer illustrated by FIG. 1 is complicated and must be carefully manually manipulated in order to permit disassembly and reassembly of the related component parts thereof when changing the process unit 6.

Figure 2:
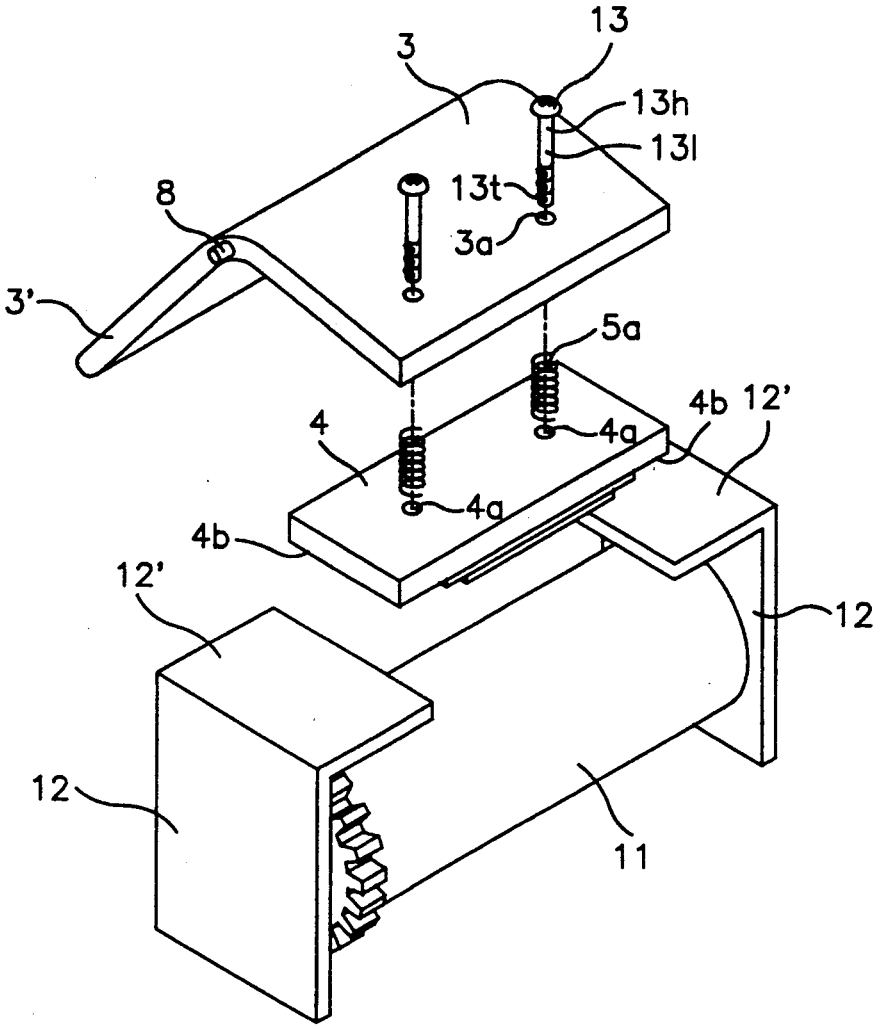
FIG. 2 is an exploded perspective view illustrating the relationship between a housing with a pair of LED positioning plates mounting the photo-sensitive drum and the LED head array according to the principles of the present invention.
Figure 3:
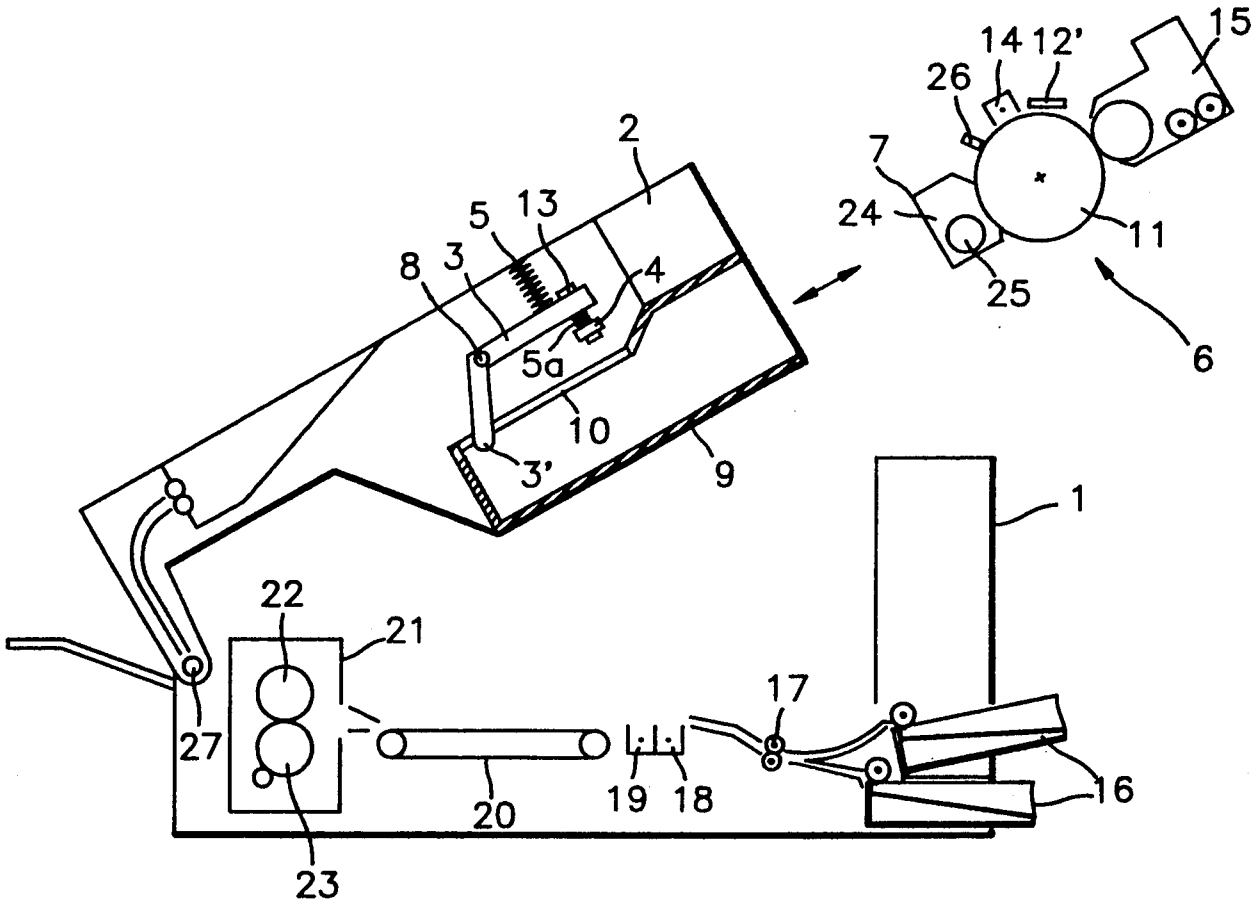
FIG. 3 is a cross-sectional view similar to FIG. 1, illustrating the structure of an LED printer constructed according to the principles of present invention.

Referring now to FIGS. 2 and 3, an embodiment constructed according to the principles of the present invention has an upper body frame 2 detachably mounted on a lower body frame 1. A bent LED frame 3 with a lever 3' defines a bellcrank that is pivotally mounted on a pivot 8 in the upper body frame 2 to support a LED head array 4 beneath the right end portion of frame 3.

A pair of through holes 3*a* are formed adjacent to and spaced-apart from the right most edge of LED frame 3. A pair threaded blind holes 4*a* are formed on LED head array 4 so as to respectively face and preferably to have centers coaxially aligned with corresponding ones of the pair of through holes 3*a*. A pair of threaded rigid, elongated fasteners or bolts 13, each having, for example, a first section 13H, an intermediate section 13I, and a threaded section 13T, are correspondingly received by the pair of through holes 3*a* for connecting the LED head array 4 to LED frame 3 by respectively threadingly engaging the lower ends of the pair of threaded bolts 13 in the pair of blind threaded holes 4*a*. Resilient elements such as a pair of compression springs 5*a* are interposed between LED frame 3 and head array 4, and respectively enclose the pair of threaded bolts 13, exerting resilient force on the LED head array 4.

Figure 5:
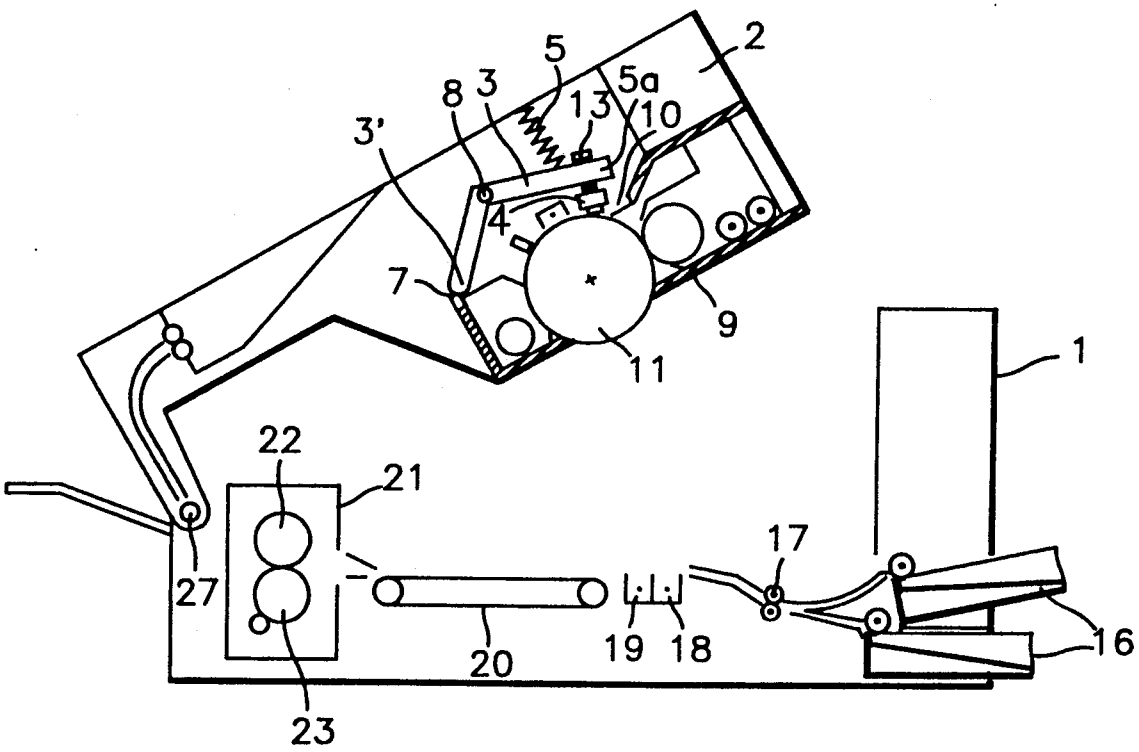
FIG. 5 is a cross-sectional view illustrating the operating position of the process unit for the embodiment shown in FIG. 3.

Referring now to FIG. 5, a resilient element such as a coil spring, a resilient means 5 is connected between the LED frame 3 and upper body frame 2 for upwardly drawing portion 3 of the LED frame supporting the LED head array 4. Image process unit 6 includes an upper leading end 7 together with a photo-sensitive drum 11 arranged in a housing 12. The process unit 6 is mounted in a unit guide 9 with an upper opening 10 for receiving the LED head array 4.

Figure 4:
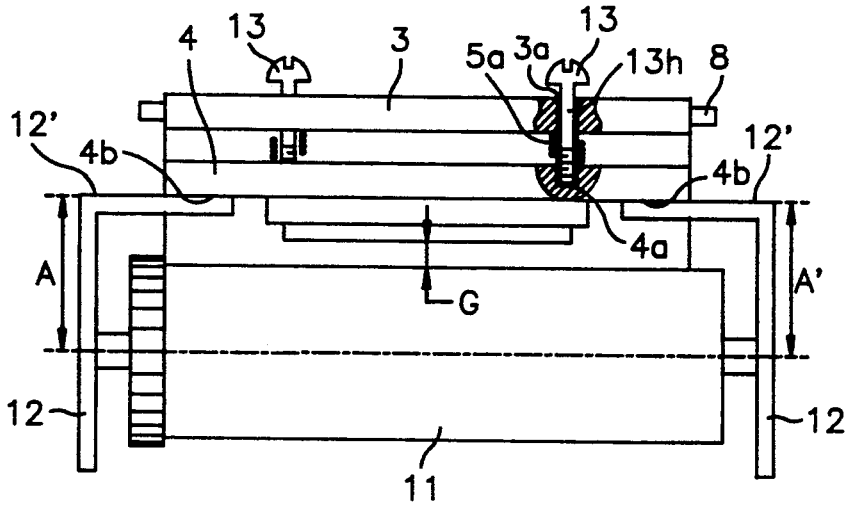
FIG. 4 is a partially cut-away elevational view illustrating the gap between the photo-sensitive drum and LED head array being properly maintained when the LED head array is placed in an operating position.

A pair of LED position determining plates 12' are formed, preferably on both of the uppermost ends of housing 12. Process unit 6 is installed inside unit guide 9 so that the upper leading end 7 serves as a cam surface and pushes lever 3' so as to pivot LED frame 3 together with the LED head array 4 clockwise (as viewed in the plane of FIG. 3). In this case, both of the oppositely disposed lower side end surfaces 4*b* of the LED head array 4 are placed to respectively contact the pair of LED positioning plates 12' with the resilient force of the pair of compression springs 5*a*, so that the gap G between the outermost circumferential surface of photo-sensitive drum 11 and lowermost surface of LED head array 4 is properly maintained, as is shown in FIG. 4.

The resilient means 5 may be a tension spring stretched to extend between the LED frame 3 and upper body frame 2, as shown in FIG. 3, or alternatively, a torsion spring arranged on the pivot 8 with one end attached to the LED frame 3 and the other end connected to the upper body frame 2, so as to cause the LED frame 3 to pivot counter clockwise on pivot 8 to the inoperative position under the restoring force of the tension or torsion spring 5. In still another embodiment, both tension and torsion springs may be used together.

The gap G between LED head array and the photosensitive drum 11 is typically usually 4 to 6 mm, which should be determined by the focal length of lens part of the LED head array. The gap G must have a precise distance extending consistently over the circumferential whole length of the photo-sensitive drum, so that the least distance A from the center line of the photo-sensitive drum and the position determining plate 12' measured in the left side is equal to the same with the least distance A' in the right side, thereby assuring that the lowermost surface of LED had array 4 and the circumferential exterior surface of dram 11 are parallel.

Process unit 6 may be removed by simply opening the upper body frame 2, because process unit 6 may be readily pulled from the inside of the guide unit 9. As process unit 6 is pulled from inside guide unit 9, the movement of process unit 6 causes the lower arm 3' and thus the right end portion of the LED frame 3 supporting the LED head array 4 to move upwardly and outwardly from the upper opening 10 of the unit guide 9 under the influence of the restoration force of resilient means 5, thereby sufficiently raising and separating the LED head array 4 from the photo-sensitive drum 11. In this sequence, LED frame 3 is pivoted on pivot 8 to an inoperative position under the restoration force of tension or torsion spring 5 connected between the upper body frame 2 and LED frame 3. Hence, both lower side end surfaces 4*b* of the LED head array are drawn apart and separated from LED position determining plates 12' of housing 12. Of course, the arm of lever 3' moves downwardly.

If process unit 6 is inserted into the unit guide 9, the upper leading end 7 pushes upwardly lever 3' of LED frame 3, so that LED frame 3 is pivoted on pivot 8 to downwardly move its right end portion supporting LED head array 4 into the upper opening 10 of unit guide 9. Then, both lower side end surfaces 4*b* of the LED head array respectively contact the pair of LED position determining plates 12' with the resilient force of the pair of compression springs 5*a* and thus the gap G between the photo-sensitive drum 11 and LED head array 4 is properly maintained, as is shown in FIG. 4. Thus, the removing of a jammed sheet of printing paper as well as changing of the process unit may be readily and easily performed in a single step.

Figure 6:
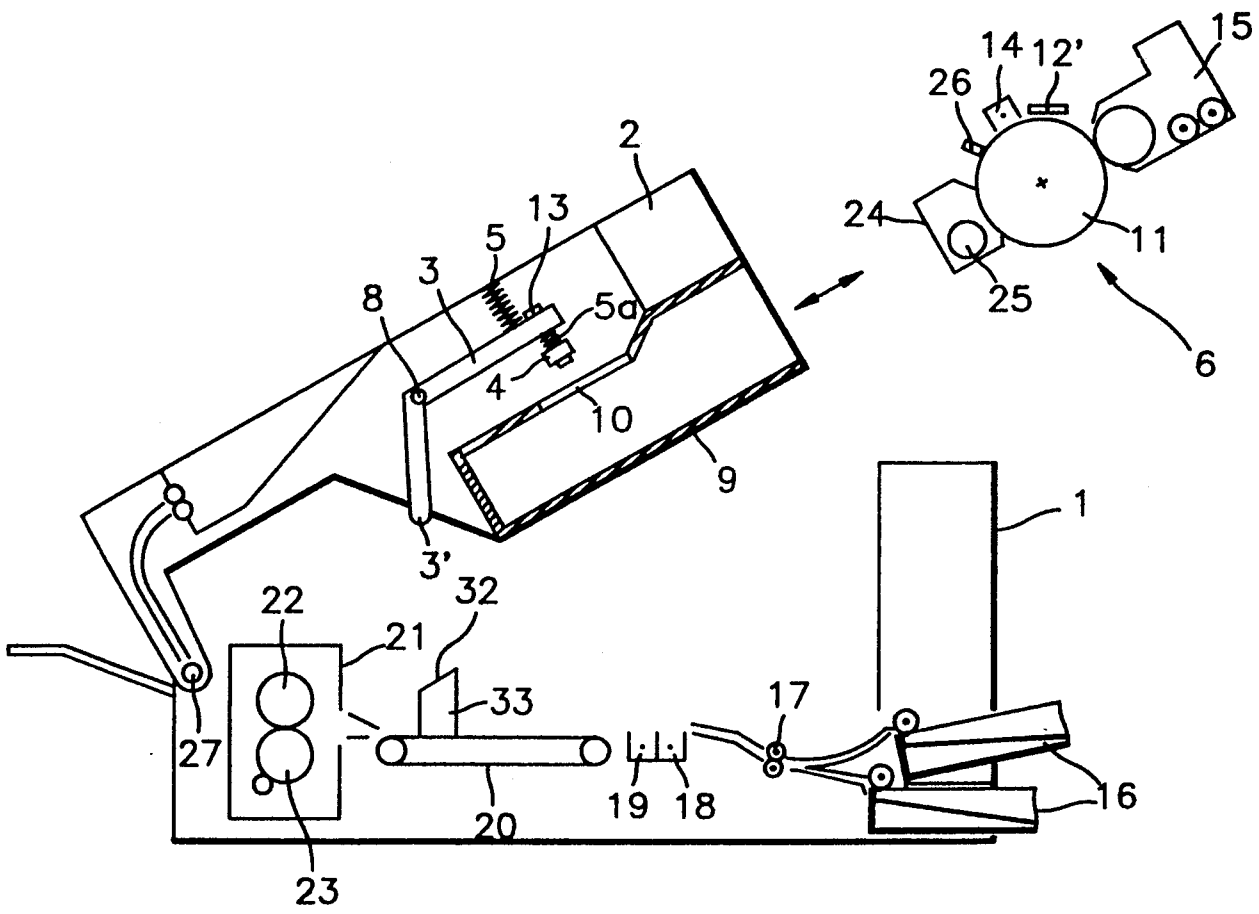
FIG. 6 is a cross-sectional view similar to FIG. 3 for illustrating the structure of an alternative embodiment of a LED printer constructed according to the principles of the present invention.
Figure 7:
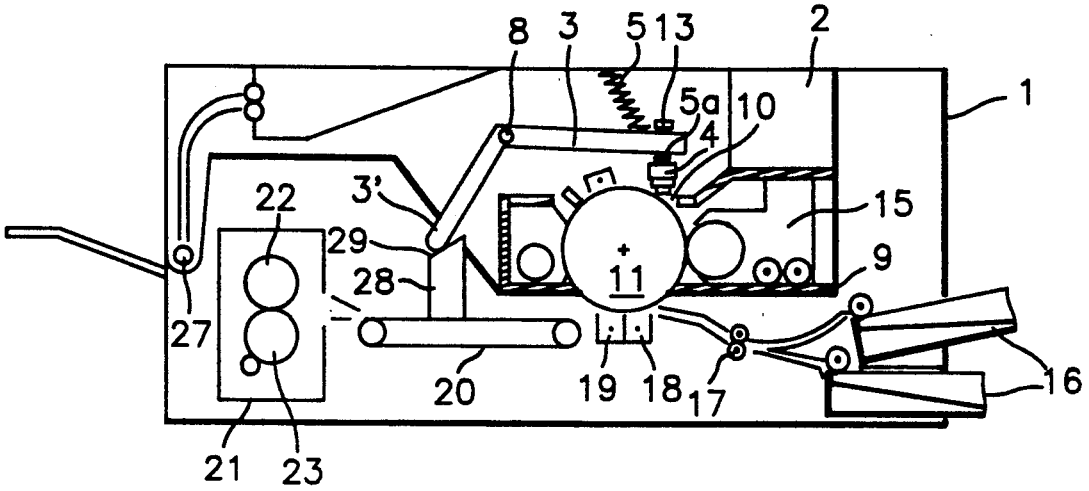
FIG. 7 is a cross-sectional view illustrating the operating position of the process unit for the embodiment shown in FIG. 6.
Figure 8:
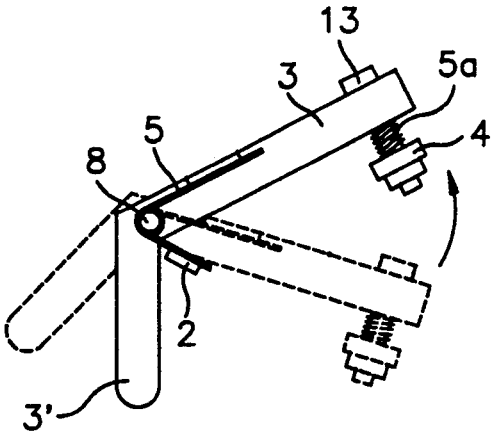
FIG. 8 is an enlarged frontal view illustrating a structure resiliently supporting the LED frame on an upper body frame.

A representation of an alternative embodiment of the present invention is shown in FIGS. 6 and 7. In this embodiment, a detent 33 serving as a cam with an upper left sloped distal surface 32 serving as a camming surface, is provided to extend upwardly from lower body frame 1. Consequently, instead of the upper leading end 7 of process unit 6 pushing the lever arm 3' as shown in FIG. 5 for the previous embodiment, closure of the printer by moving upper body 2 around hinge pin 27 toward lower body 1 causes surface 32 to engage and rotate the distal end of lower arm 3' clockwise around pivot 8. Namely, lever 3' is to be guided along the upper left sloped surface 32 of the detent 33. In operation, when upper body frame 2 is opened to change process unit 6 or to remove a jammed sheet of paper, lever 3' of LED frame 3 is separated from detent 33 so as to pivot LED frame 3 on pivot 8 under the restoration force of spring 5, thus moving LED head array 4 upwardly and out of upper opening 10 in guide unit 9. Of course, through holes 3*a*, blind holes 4*a*, compression springs 5*a* and bolts 13 for resiliently connecting the LED head array 4 to the LED frame 3 are also present in this embodiment, just as in the embodiment represented by FIG. 3.

As the upper body frame 2 is closed with process unit 6 inserted guide unit 9 to engage the lower body frame 1, lever arm 3' is guided by upper left sloped surface 32 of the detent 33 and is pushed upwardly so that LED frame 3 is pivoted on pivot 8 to downwardly move LED head array 4 into upper opening 10 of unit guide 9. Then, both lower side end surfaces 4*b* of the LED head array respectively contact the pair of LED position determining plates 12' with the resilient force of the pair of compression springs 5*a* and thus the gap G between photo-sensitive drum 11 and LED head array 4 is properly established and maintained, as is shown in FIG. 4. In this case, spring 5 is stretched under tension, as shown in FIG. 7.

Thus, according to principles of the present invention, whenever the upper body frame is separated from the lower body frame, the LED head array is automatically released from the unit guide by the force of the spring attached to the LED frame, thereby facilitating the changing of the process unit as well as the removing of jammed sheets of paper. Moreover, the gap between the photo-sensitive drum and LED bead array is always kept constant by means of the structure formed by of the through holes 3*a*, blind holes 4*a*, springs 5*a*, bolts, position determining plates 12' and the under side end surfaces 4*b* of LED head array 4. In effect, the combination of threaded fasteners 13 and coil springs 5*a* permits LED head array 4 to remain stationary after the under surfaces 4*b* contacts the upper end surfaces 12' of housing 12, while either leading edge 7 of process unit 6 or camming surface 32 of detent 33 continues to displace the lower arm 3' during installation of process unit 6 into guide unit 9 or rotation of upper body frame 2 around hinge 27 toward lower body frame 1, respectively. Of course, a structure constructed according to the foregoing principles may be incorporated into a facsimile communication machine other modifications contemplate a resilient element interposed between the digital arm 3 and the LED head array independently of the locations of fasteners 13. Preferably however, fasteners 13 serve to facilitate installation of resilient elements such as springs 5*a* during manufacture assembly, and to maintain position of those elements during operation. Moreover, the embodiments constructed according to the foregoing principles accommodate a wider range of manufacturing and operational wear tolerances while continuously maintaining the gap between the light emitting head array and the photosensitive drum over the entire length of both the light emitting head array and the circumferential surface of the photo-sensitive drum.

What is claimed is:

1. A light emitting diode printer, comprising:

a head array of a plurality of light emitting diodes;

a lower body frame;

an upper body frame detachably mounted upon said lower body frame;

process means comprising a housing with an upper leading end, for receiving a photo-sensitive drum within said housing;

frame means with a first arm, a second arm extending from said first arm, and means for pivoting said frame means relative to said upper body frame, and frame means for supporting said head array beneath a distal portion of said first arm;

a plurality of through holes formed adjacent to said distal portion of said first arm;

a plurality of blind holes formed in said head array in corresponding alignment with said plurality of through holes;

a plurality of fasteners received through corresponding ones of said through holes, connecting said head array to said frame means by coupling lower ends of said fasteners to said blind holes;

first resilient means interposed between said frame means and said head array, for exerting resilient force on said head array;

second resilient means disposed between said frame means and said upper body frame, for urging upwardly said distal portion of said first arm; and a plurality of plates formed on opposite upper side ends of said housing to engage opposite sides of said head array.

2. The printer of claim 1, further comprising:

said upper body frame comprising means for removably receiving said housing; and said leading end engaging said second arm and pivoting said frame means in a first direction as said process means is inserted into said receiving means and said opposite sides of said head array engage said opposite upper side ends of said housing.

3. The printer of claim 1, wherein said second resilient means comprises a spring arranged on said frame means with one end of said spring attached to said frame means and with a second end of said spring connected to said upper body frame to bias said frame means to pivot away from said opposite upper side ends of said housing to an inoperative position under force of said spring.

4. The printer of claim 1, wherein said second resilient means comprises a spring interposed between said frame means and upper body frame to cause said frame means to pivot away from said opposite upper side ends of said housing on said pivoting means.

5. A light emitting diode printer, comprising:

a lower body frame;

an upper body frame detachably mounted on said lower body frame;

process means comprising a photo-sensitive drum and a housing mounting said drum and providing an upper leading end, for imparting information upon printable media;

frame means having a right end portion, a pivot and a lever mounted by means of said pivot on said upper body frame, for supporting a light emitting diode head array beneath said right end portion;

resilient means arranged between said frame means and said upper body frame, for biasing said right end portion upwardly toward a position away from the photo-sensitive drum; and position determining means for closely contacting both opposite lower side end surfaces of the head array with said housing, whereby said upper leading end pushes said lever so as to pivot said frame means together with said head array clockwise when said process means is installed inside said upper body frame, so that both lower side end surfaces of said head array contact said housing so as to maintain a gap between said photo-sensitive drum and head array.

6. A light emitting diode printer, comprising:

a lower body frame;

a cam having an upper sloped surface provided in said lower body frame;

an upper body frame detachably mounted on said lower body frame;

a process unit with an upper leading end, receiving a photo-sensitive drum in a housing;

a frame means with a right end portion, a pivot and lever mounted by means of said pivot on said upper body frame, for supporting a light emitting diode head array beneath said right end portion;

a pair of through holes formed adjacent to said right end portion of said frame means;

a pair of blind holes formed on said head array so as to face corresponding ones of said pair of through holes;

a pair of threaded bolts respectively received by said pair of through holes, connecting said head array to said frame means by respectively fixing the lower ends of said pair of threaded bolts in said pair of blind holes;

a pair of compression springs interposed between said frame means and head array, surrounding corresponding ones of said pair of threaded bolts and exerting resilient force between said head array and said right end portion;

resilient means arranged between said frame means and said upper body frame, for biasing said right end portion upwardly toward a position away from said photo-sensitive drum; and a pair position determining plates formed on both upper side ends of said housing, whereby said sloped surface pushes said lever so as to pivot said frame means together with said head array clockwise when said upper body frame is operatively mounted on said lower body frame, so that both lower side end surfaces of said head array contact corresponding ones of said pair of position determining plates under the resilient force of said pair of compression springs and a gap is thereby maintained between said photo-sensitive drum and head array.

7. The printer of claim 6, wherein said resilient means comprises a torsion spring arranged with one end of said torsion spring attached to said frame means and a second end of said torsion spring is connected to said upper body frame so as to cause said frame means to pivot counter-clockwise on said pivot to an inoperative position under restoration recovering force of said torsion spring.

8. The printer of claim 6, wherein said resilient means comprises a spring interposed between said frame means and upper body frame so as to cause said frame means to pivot counter-clockwise on said pivot.

9. A light emitting diode printer, comprising:

a head array comprised of a plurality of light emitting diodes;

a body comprising means for accommodating insertion of process means comprising a photo-sensitive surface and a housing mounting the photo-sensitive surface, for imparting information upon printable media;

frame means comprising a first arm, a second arm connected to said first arm and disposed to intercept said housing during said insertion, and means for pivotally supporting said frame means within said body, said frame means for supporting said head array from a distal end of said first arm, for conveying said head array to an operative position spaced-apart by a first distance from said photo-sensitive surface from an inoperative position spaced-apart from said photo-sensitive surface by a second distance greater than said first distance, as said insertion enables said housing to displace said second arm;

a plurality of bearing surfaces positioned to engage opposite side ends of said head array while said head array is in said operative position; and means engaging said frame means, for flexibly suspending said head array from said distal end of said first arm.

10. The printer of claim 9, further comprised of resilient means disposed between said frame means and said body, for biasing said first arm toward said inoperative position.

11. The printer of claim 10, further comprised of said suspending means accommodating travel of said first arm as said insertion continues to displace said second arm after said head array is in said operative position.

12. The printer of claim 9, further comprised of said suspending means accommodating travel of said first arm as said insertion continues to displace said second arm after said head array is in said operative position.

13. The printer of claim 9, further comprising said suspending means comprising first means for engaging said first arm, second means for engaging said head array, and intermediate means extending between said first means and said second means and for allowing relative movement between said frame means and said second means and for allowing relative movement between said frame means and said head away after said head array after said head array attains said operative position.

14. The printer of claim 13, further comprised of said intermediate means comprising:

a rigid, elongate member extending between and connecting first means and said second means; and resilient means disposed between said first arm and said head array, for accommodating said movement.

15. The printer of claim 13, further comprised of said intermediate means comprising:

a rigid elongate member extending between and connecting first means and said second means; and resilient means disposed between said first arm and said head array, for maintaining an orientation between said first arm and said head array during said conveying, and for accommodating said movement after said head array attains said operative position.

16. The printer of claim 13, further comprised of:

said first arm being perforated by an aperture; and said intermediate means extending through said aperture and terminating at one end in said first means with said first means positioned to restrict said movement, said intermediate means terminating at a second end in said second means with said second means remaining stationary relative to said head array during said conveying.

17. The printer of claim 16, further comprised of said intermediate means comprising a resilient means interposed between said first arm and said head array, for maintaining a constant separation between said first arm and said head array during said conveying and for absorbing said relative movement.

18. The printer of claim 9, further comprising process means having an exterior configuration of said housing conforming to said accommodating means, a photo-sensitive surface and a housing mounting said photo-sensitive surface, for imparting images upon printable media received by said printer.

19. A light emitting diode printer, comprising:

a head array comprised of a plurality of light emitting diode;

a body comprising a cam surface and means for accommodating insertion of process means comprising a photo-sensitive surface and a housing mounting the photo-sensitive surface, for imparting information upon printable media, said body positioning the photo-sensitive surface to receive the printable media after said insertion;

frame means comprising a first arm, a means for pivotally supporting said frame means within said body, and a second arm connected to said first arm and disposed intercept said cam surface during said insertion, said frame means provides for support of said head array at a distal end of said first arm;

said frame means further provides for conveying said head array to an operative position spaced apart by a first distance from said photosensitive surface from an inoperative position spaced apart from said photosensitive surface by a second distance greater than said first distance, as said insertion enables said cam surface to displace said second arm;

a plurality of bearing surfaces positioned to engage opposite side ends of said head array while said head array is in said operative position; and means engaging said frame means, for flexibly suspending said head array from said distal end of said first arm.

20. The printer of claim 19, further comprised of resilient means disposed between said frame means and said body, for biasing said first arm toward said inoperative position.

21. The printer of claim 20, further comprised of said suspending means for accommodating extended travel of said first arm as continued insertion of said process means causes the cam surface to continue to displace said second arm even after said head array is in said operative position.

22. The printer of claim 19, further comprised of said suspending means for accommodating extended travel of said first arm as continued insertion of said process means causes the cam surface to continue to displace said second arm even after said head array is in said operative position.

23. The printer of claim 19, further comprising said suspended means comprising a first means for engaging said first arm, second means for engaging said head array, and intermediate means extending between said first means and said second means and for allowing relative movement between said frame means and said head array after said head array attains said operative position.

24. The printer of claim 23, further comprised of said intermediate means comprising:

a rigid, elongate member extending between and connecting first means and said second means; and resilient means disposed between said first arm and said head array, for accommodating said movement.

25. The printer of claim 23, further comprised of said intermediate means comprising:

a rigid elongate member extending between said connecting first means and said second means; and resilient means disposed between said first arm and said head array, for maintaining an orientation between said first arm and said head array during said conveying, and for accommodating said movement after said head array attains said operative position.

26. The printer of claim 23, further comprised of:

said first arm being performed by an aperture; and said intermediate means extending through said aperture and terminating at one end in said first means with said first means positioned to restrict said movement, said intermediate means terminating at a second end in said second means with said second means remaining stationary relative to said head array during said conveying.

27. The printer of claim 26, further comprised of said intermediate means comprising a resilient means interposed between said first arm and said head array, for maintaining a constant separation between said first arm and said head array during said conveying and for absorbing said relative movement.

28. The printer of claim 19, further comprising process means having an exterior configuration of said housing conforming to said accommodating means, a photo-sensitive surface and a housing mounting said photo-sensitive surface, for imparting images upon printable media received by said printer.

* * * * *

UNITED STATES PATENT AND TRADEMARK OFFICE

CERTIFICATE OF CORRECTION

PATENT NO. : 5,291,249
DATED : March 1, 1994
INVENTOR(S) : Dong-Ho Lee

It is certified that error appears in the above-indentified patent and that said Letters Patent is hereby corrected as shown below:

| | | |
|---|---|---|
| Column 9, | Line 42, | After "head", Change "away" to --array-- ; |
| Column 10, | Line 17, | Change "diode" to --diodes-- ; |
| | Line 28, | Preceding "intercept," insert --to--. |
| | Line 28, | Preceding "intercept", Insert --to-- . |

Signed and Sealed this

Eleventh Day of October, 1994

*Attest:*

Bruce Lehman

BRUCE LEHMAN

*Attesting Officer*

*Commissioner of Patents and Trademarks*